US011052444B2

(12) United States Patent
Tobita et al.

(10) Patent No.: US 11,052,444 B2
(45) Date of Patent: Jul. 6, 2021

(54) METHOD FOR MANUFACTURING PRESS FORMED PRODUCT

(71) Applicant: JFE Steel Corporation, Tokyo (JP)

(72) Inventors: Shunsuke Tobita, Tokyo (JP); Toyohisa Shinmiya, Tokyo (JP); Yuji Yamasaki, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 41 days.

(21) Appl. No.: 16/634,997

(22) PCT Filed: Jul. 25, 2018

(86) PCT No.: PCT/JP2018/027942
§ 371 (c)(1),
(2) Date: Jan. 29, 2020

(87) PCT Pub. No.: WO2019/026732
PCT Pub. Date: Feb. 7, 2019

(65) Prior Publication Data

US 2020/0238355 A1 Jul. 30, 2020

(30) Foreign Application Priority Data

Aug. 2, 2017 (JP) ..... JP2017-150070

(51) Int. Cl.
*B21D 5/01* (2006.01)
*B21D 22/02* (2006.01)
(Continued)

(52) U.S. Cl.
CPC ..... *B21D 5/01* (2013.01); *B21D 22/02* (2013.01); *B21D 22/26* (2013.01); *B21D 22/30* (2013.01); *B21D 24/005* (2013.01)

(58) Field of Classification Search
CPC ..... B21D 22/20; B21D 22/21; B21D 22/22; B21D 22/26; B21D 22/30; B21D 24/005; B21D 5/01
(Continued)

(56) References Cited

U.S. PATENT DOCUMENTS 10,688,551 B2 6/2020 Aso et al.
2013/0104618 A1* 5/2013 Daimaru ..... B21D 22/00 72/362
(Continued)

FOREIGN PATENT DOCUMENTS

CN 104684661 A 6/2015
EP 3015185 A1 5/2016
(Continued)

OTHER PUBLICATIONS

Ohinese Office Action with Search Report for Chinese Application No. 201880050066.8, dated Jan. 19, 2021, 11 pages.
(Continued)

*Primary Examiner* — Adam J Eiseman
*Assistant Examiner* — Matthew Stephens
(74) *Attorney, Agent, or Firm* — RatnerPrestia

(57) ABSTRACT

A method for manufacturing a press formed product is disclosed. The method for manufacturing a press formed product includes: when a metal sheet is press formed to manufacture a product having a product shape of a hat-shaped cross-section, in which a top plate part and a flange part are continuous in a width direction through a side wall part and the top plate part and the flange part curve convexly or concavely toward the top plate part along a longitudinal direction, a first step of manufacturing an intermediate component by press forming into a component shape having a hat-shaped cross-section, in which a curve of each of the top plate part and the flange part along the longitudinal
(Continued)

direction has a second curvature radius smaller than a curvature radius in the product shape; and a second step of press forming the intermediate component into the product shape.

20 Claims, 2 Drawing Sheets

(51) Int. Cl.
*B21D 22/26* (2006.01)
*B21D 22/30* (2006.01)
*B21D 24/00* (2006.01)

(58) Field of Classification Search
USPC ..... 72/379.2, 702
See application file for complete search history.

(56) References Cited

U.S. PATENT DOCUMENTS

| | | | | |
|---|---|---|---|---|
| 2015/0273563 | A1 | 10/2015 | Miyagi et al. | |
| 2017/0266706 | A1* | 9/2017 | Ito | B21D 22/26 72/362 |
| 2018/0264534 | A1* | 9/2018 | Aso | B21D 22/30 72/362 |
| 2019/0030583 | A1* | 1/2019 | Nishimura | B21D 22/02 72/362 |

FOREIGN PATENT DOCUMENTS

| | | | | | |
|---|---|---|---|---|---|
| JP | 2006116554 | A | * | 5/2006 | B21D 37/02 |
| JP | 2007190588 | A | | 8/2007 | |
| JP | 2007286841 | A | | 11/2007 | |
| JP | 2008073697 | A | * | 4/2008 | B21D 22/26 |
| JP | 2008221289 | A | * | 9/2008 | B21D 22/26 |
| JP | 2008221289 | A | | 9/2008 | |
| JP | 2011206789 | A | | 10/2011 | |
| JP | 2016087625 | A | | 5/2016 | |
| WO | 2016104376 | A1 | | 6/2016 | |
| WO | 2016136612 | A1 | | 9/2016 | |
| WO | 2017149955 | A1 | | 9/2017 | |

OTHER PUBLICATIONS

Extended European Search Report for European Application No. 18 841 303.3, dated May 20, 2020, 7 pages.
International Search Report and Written Opinion for International Application No. PCT/JP2018/027942, dated Oct. 23, 2018, 5 pages.
International Preliminary Report on Patentability and Written Opinion for International Application No. PCT/JP2018/027942, dated Feb. 4, 2020, 6 pages.

* cited by examiner

METHOD FOR MANUFACTURING PRESS FORMED PRODUCT

CROSS REFERENCE TO RELATED APPLICATIONS

This is the U. S. National Phase application of PCT/JP2018/027942, filed Jul. 25, 2018, which claims priority to Japanese Patent Application No. 2017-150070, filed Aug. 2, 2017, the disclosures of these applications being incorporated herein by reference in their entireties for all purposes.

FIELD OF THE INVENTION

The present invention relates to a method for manufacturing a press formed product, by which a metal sheet is formed into a hat-shaped cross-section component having a top plate part and a flange part which curve convexly or concavely toward the top plate part along a longitudinal direction.

BACKGROUND OF THE INVENTION

In order to satisfy both of improvement in crash safety and weight saving of a vehicle body, application of a high tensile strength steel sheet to a vehicle structural component has been recently developed. Since the high tensile strength steel sheet has high yield strength and tensile strength, a forming defect such as spring-back becomes a problem in performing press forming.

Examples of a press formed product used in a vehicle structural component include a hat-shaped cross-section component having a top plate part and a flange part which curve at a predetermined curvature radius along a longitudinal direction, such as a B pillar outer. When such a component is press formed, a tensile stress is generated in the top plate part and a compressive stress is generated in the flange part at a forming bottom dead center, and spring-back (camber-back) is generated due to a stress difference thereof. When a high tensile strength steel sheet is applied to such a component, a problem of increase in the stress difference at the bottom dead center described above and increase in spring-back occurs. Furthermore, in the high tensile strength steel sheet, variation in a material strength becomes large, thereby leading to large variation in dimensional accuracy, in other words, material strength sensitivity is large.

As a conventional technology for the above problem, there are press forming methods described in PTLs 1 to 3.

In the method described in PTL 1, for a formed component having a top plate part curved in a longitudinal direction and two side wall parts extending toward the inside of a curve from both ends of the top plate part along the longitudinal direction, a curvature of the top plate part and an angle between the top plate part and each of the side wall parts in a preceding step are changed. Accordingly, in the method described in PTL 1, a stress to be generated in a subsequent step is reduced, thereby leading to suppression of spring-back.

In the method described in PTL 2, in a press forming step of a metal sheet, in which the metal sheet reaches a final press formed product shape after multiple press forming steps, near a ridge line having a predetermined curvature in a shape after the forming, a part where a residual tensile stress is to be generated is formed in a preceding step at a curvature radius smaller than the final shape, and a part where a residual compressive stress is to be generated is formed in the preceding step at a curvature radius larger than the final shape. Accordingly, in the method described in PTL 2, the residual stress is canceled, and spring-back is reduced.

The method described in PTL 3 is a method of producing a die that anticipates warpage to be generated in press forming, and spring-back is reduced by performing press forming using the anticipated shape.

PATENT LITERATURE

PTL 1: JP 2011-206789 A
PTL 2: JP 2007-190588 A
PTL 3: JP 2007-286841 A

SUMMARY OF THE INVENTION

However, in the method described in PTL 1, only the curvature radius of the top plate part in a side view is changed, and thus, a stress to be generated in a flange part is not improved. In particular, for a high tensile strength steel sheet where the amount of spring-back becomes large, the spring-back is not sufficiently suppressed, and the material strength sensitivity cannot be reduced.

In the method described in PTL 2, the size tendency of the curvatures to be changed varies according to the part where the compressive stress or the tensile stress is to be generated, and thus, design of a die becomes complex.

In the method described in PTL 3, a residual stress at a press bottom dead center cannot be made zero, and thus, the material strength sensitivity is not reduced.

Aspects of the present invention have been made in view of the above problems and provide a method for manufacturing a press formed product, which can greatly reduce spring-back in a side view, that is, camber-back, and the material strength sensitivity of the camber-back without complicating a die even when a high tensile strength steel sheet is used.

In order to solve the problems, a method for manufacturing a press formed product of one embodiment of the present invention includes: when a metal sheet is press formed to manufacture a product having a product shape of a hat-shaped cross-section, in which a top plate part and a flange part are continuous in a width direction through a side wall part and the top plate part and the flange part curve convexly or concavely toward the top plate part along a longitudinal direction, a first step of manufacturing an intermediate component by press forming into a component shape having a hat-shaped cross-section, in which a curve of each of the top plate part and the flange part along the longitudinal direction has a second curvature radius smaller than a curvature radius in the product shape; and a second step of press forming the curve of the intermediate component along the longitudinal direction to have a larger curvature radius than the product shape.

According to one embodiment of the present invention, even when a high tensile strength steel sheet is used for a metal sheet, spring-back in a side view, that is, camber-back, and the material strength sensitivity of the camber-back can be greatly reduced without complicating a die. Accordingly, a component having a high-accuracy hat-shaped cross-section curved shape close to an intended product shape can be obtained. More specifically, according to one embodiment of the present invention, a method for manufacturing a press formed product having excellent shape fixability and material strength sensitivity can be provided.

As a result, according to one embodiment of the present invention, even when the material strength varies, a component having high dimensional accuracy can be obtained, thereby leading to improvement in yield. Furthermore, when a vehicle structural component is made using a component having a hat-shaped cross-sectional shape, assembly of the component can be easily performed.

BRIEF DESCRIPTION OF THE DRAWINGS

FIG. 2 is a schematic view illustrating a product shape according to embodiments based on the present invention and FIG. 2A is an oblique view and FIG. 2B is a side view;

DETAILED DESCRIPTION OF EMBODIMENTS OF THE INVENTION

Embodiments according to the present invention will be described below with reference to the drawings.

The embodiments described below illustrate configurations to embody the technical idea according to aspects of the present invention, and the technical idea according to aspects of the present invention does not limit the material, shape, structure, and the like of a component to those described below. Various changes can be added to the technical idea according to aspects of the present invention within the technical scope defined by claims.

Figure 1A:
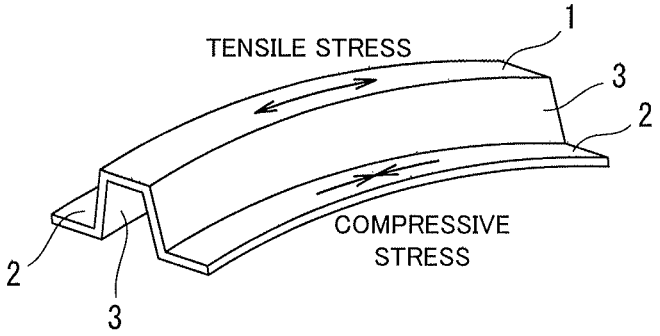
FIGS. 1A and 1B are schematic views explaining spring-back in a hat-shaped cross-section component.
Figure 1B:
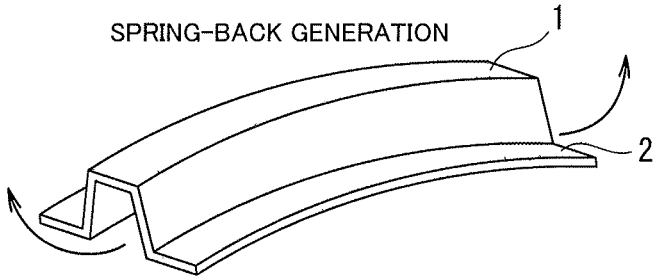

When a metal sheet made of a blank material is press formed into a hat-shaped cross-section component, in which both sides of a top plate part 1 in a width direction are continuous with flange parts 2 through side wall parts 3, which curves convexly toward the top plate part 1 along a longitudinal direction, as illustrated in FIG. 1A, as a residual stress, a tensile stress is generated in the top plate part 1 and a compressive stress is generated in the flange parts 2 in the curved part. Then, when the stresses are released by removing the component from a pressing die, spring-back as illustrated in FIG. 1B is generated. In this case, when the residual stress increases with increasing the material strength of the metal sheet, the amount of spring-back tends to increase. More specifically, the adoption of a high tensile strength steel sheet of 590 MPa or more causes large spring-back.

As illustrated in FIG. 2, an intended product shape of the present embodiment by press forming is a hat-shaped cross-section member, in which the both sides of the top plate part 1 in the width direction are continuous with the flange parts 2 through the side wall parts 3, which curves such that the tap plate part 1 and the flange parts 2 are convex toward the top plate part 1 along the longitudinal direction. The curvatures of the curves along the longitudinal direction, which are respectively formed in the top plate part 1 and the flange parts 2, may be different. In the present embodiment, the curvatures of the curves of the top plate part 1 and the flange parts 2 are the same.

Furthermore, although a basic shape of the product shape of the present embodiment is a simple curved shape as illustrated in FIG. 2, an actual component shape can also be applied. As an example of the actual component shape, a curved component simulating a B pillar R/F is illustrated in FIG. 3. In the curved component, both ends of a top plate part 1 in a longitudinal direction are continuous with projection parts 5, respectively. Since the width of each of the projection parts 5 has a larger dimension in a width direction than the width of the top plate part 1, a top plate surface of the product shape on the end side in the longitudinal direction has an L-shape or a T-shape in a top view. FIG. 3 illustrates the T-shape. Furthermore, lower ends of vertical wall parts 6 are continuous with ends of flange parts 2 in the longitudinal direction. The vertical wall parts 6 rise toward the top plate part 1, and upper ends thereof are continuous with the projection parts 5. The above shape makes a main body part 4 having curved end parts extend in a perpendicular direction with respect to the vertical wall parts 6. More specifically, the vertical wall parts 6 rise to be opposed to the longitudinal direction of the main body part 4. The vertical wall parts 6 may exist on only one side in the longitudinal direction.

However, in a method for manufacturing a press formed product according to aspects of the present invention, even a product shape without the projection parts 5 and the vertical wall parts 6 can be applied. Furthermore, even a curved shape, in which the top plate part 1 and the flange parts 2 are concave toward the top plate part 1 along the longitudinal direction, can be applied.

Figure 4:
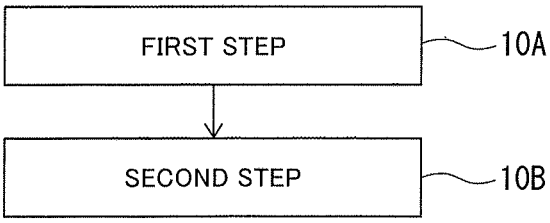
FIG. 4 is a view illustrating steps of a method for manufacturing a press formed product according to the embodiments based on the present invention.

As illustrated in FIG. 4, the method for manufacturing a press formed product of the present embodiment includes a first step 10A and a second step 108 as processing for forming a tabular metal sheet into the above product shape. Two or more multiple steps as a press step for manufacturing a press formed product lead to improvement in dimensional accuracy, such as suppression of spring-back of a product.

The method for manufacturing a press formed product includes trim processing (not illustrated) for trimming the outer periphery of the flange. The trim processing may be performed before the first step 10A, may be performed between the first step 10A and the second step 10B, or may be performed after the second step 10B. In the present embodiment, the case where the trim processing is performed after press processing in the first step 10A will be described. In this case, an intermediate component is a component in a state where the trim processing of the outer periphery of the flange has been performed.

The first step 10A is a step of manufacturing an intermediate component by press forming a tabular metal sheet (blank material) into a component shape having a hat-shaped cross-section, in which the curve along the longitudinal direction of each of the top plate part 1 and the flange parts 2 has a second curvature radius smaller than a curvature radius in the above product shape. As the metal sheet, even a steel sheet having a material strength of 590 MPa or more can be applied.

In many cases, the second curvature radius of the top plate part 1 and the second curvature radius of each of the flange parts 2 are set to be different sizes.

Furthermore, it is preferable that forming is performed with a die by which the second curvature radius of each of the top plate part 1 and the flange parts 2 is set to be a value such that a curvature radius after spring-back generated in the intermediate component after the forming in the first step 101 is equal to or less than the curvature radius in the product shape or, preferably, less than the curvature radius in the product shape.

For example, when a curvature radius of the top plate part 1 along the longitudinal direction of the top plate part 1 in the product shape is defined as $R1_o$, the value of the second curvature radius in the top plate part 1 is preferably set such that a curvature radius R1' of the top plate part 1 along the longitudinal direction after the spring-back in the intermediate component becomes a value that satisfies the following equation (1). More specifically, the value of the second curvature radius in the top plate part 1 is set such that the intermediate component after the spring-back has a curvature radius on the spring-go side compared to the product shape.

$$0.70 \leq (R1'/R1_o) < 1.00 \quad (1)$$

Furthermore, when a curvature radius of each of the flange parts 2 along the longitudinal direction in the product shape is defined as $R2_o$, the value of the second curvature radius in each of the flange parts 2 is preferably set such that a curvature radius R2' of each of the flange parts 2 along the longitudinal direction after the spring-back in the intermediate component becomes a value that satisfies the following equation (2). More specifically, the value of the second curvature radius in each of the flange parts 2 is set such that the intermediate component after the spring-back has a curvature radius on the spring-go side compared to the product shape.

$$0.70 \leq (R2'/R2_o) < 1.00 \quad (2)$$

Drawing or stamping may be applied to the forming in the first step 10A.

Each of the curvature radii after the spring-back generated in the intermediate component may be determined by calculation by performing CAE analysis or another simulation analysis with a computer or may be determined by actual measurement of an actually manufactured test product.

Furthermore, in the present embodiment, the trim processing of the outer periphery of the flange is performed after the press forming in the first step 10A. As the trim processing, known processing methods such as shear processing and laser cutting processing may be adopted.

The second step 10B is, for example, a step of forming the intermediate component manufactured in the first step 10A into the intended product shape. In this case, in the second step 10B, the curve of the intermediate component along the longitudinal direction is press formed to have a larger curvature radius than the product shape. When the press forming is performed in order that the curvature radius of the curve of the intermediate component along the longitudinal direction is larger than that of the product shape, the curvature radius is set to be a value such that the curvature radius of the curve along the longitudinal direction in the formed shape after being removed from the die in the second step 10B is closer to the intended curvature radius in the product shape than the curvature radius in the intermediate component. The curvature radius may be determined by FEM analysis or experiments.

For example, the curvature radius of the die used in the second step 10B along the longitudinal direction of the product shape is designed to be a larger value than the curvature radius of the curve of the product shape along the longitudinal direction such that, in the top plate part 1 and the flange parts 2, the tensile stress or the compressive stress generated in the first step 10A and the compressive stress or the tensile stress generated in the second step 10B cancel each other, and the stress along the longitudinal direction is close to zero.

For example, when a curvature radius of the top plate part 1 along the longitudinal direction of the top plate part 1 in the product shape is defined as $R3_o$, the value of the curvature radius in the top plate part 1 in the second step 10B is preferably set such that a curvature radius $R3_o'$ of the top plate part of the die in the second step 10B along the longitudinal direction becomes a value that satisfies the following equation (3).

$$1.00 < (R3_o'/R3_o) \leq 3.00 \quad (3)$$

Furthermore, for example, when a curvature radius of each of the flange parts 2 along the longitudinal direction of each of the flange parts 2 in the product shape is defined as $R4_o$, the value of the curvature radius in each of the flange parts 2 in the second step 10B is preferably set such that a curvature radius $R4_o'$ of each of the flange parts 2 of the die in the second step 10B along the longitudinal direction becomes a value that satisfies the following equation (4).

$$1.00 < (R4_o'/R4_o) \leq 3.00 \quad (4)$$

When $(R3_o'/R3_o)$ and $(R4_o'/R4_o)$ are less than 1.0, the tensile stress remains in the top plate part 1 and the compressive stress remains in the flange parts 2 at a bottom dead center of the die of the second step 10B, and thus, the spring-back might not be sufficiently suppressed. Furthermore, even when the stresses are reversed, spring-back (spring-go) is generated to make the curvature radius smaller after the die of the second step 10B is removed, and thus, the curvature radius might be smaller than that of the product shape. In contrast, when $(R3_o'/R3_o)$ and $(R4_o'/R4_o)$ are more than 3.00, an excessive compressive stress is generated in the top plate part 1 and an excessive tensile stress is generated in the flange parts 2 at a forming bottom dead center in the second step 10B, and thus, excessive spring-go might be generated in the formed component.

In these cases, restrike processing may be applied to the forming in the second step 10B.

(Operations and Others)

In the method for manufacturing a press formed product of the present embodiment, in order to reduce spring-back, press forming is performed such that the curvature radius of each of the top plate part 1 and the flange parts 2 becomes smaller than the curvature radius of the product shape in the first step 10A, and the intermediate component obtained in the first step 10A is press formed to have a larger curvature radius than the product shape in the second step 10B, so that a component having an intended formed shape is obtained.

In the first step 10A, the curvature radius of each of the top plate part 1 and the flange parts 2 of the intermediate component after being removed from the die may sometimes become slightly larger than the curvature radius of the die used in the first step 10A due to spring-back, depending on the value of the second curvature radius. It is preferable that the die of the first step 10A is designed such that the curvature radius of each of the top plate part 1 and the flange parts 2 of the intermediate component formed in the first step 10A after the spring-back is equal to or less than the curvature radius in the product shape or, preferably, less than the curvature radius in the product shape.

A high tensile strength steel sheet is targeted as the metal sheet to be press processed, but a steel sheet or an aluminum sheet may be used. Furthermore, the curvature radius of the top plate part 1 and the curvature radius of each of the flange parts in the product shape along the longitudinal direction may be different.

In the forming of the first step 10A, the forming is performed such that the curvature radius of each of the top plate part 1 and the flange parts 2 of the intermediate component after the spring-back is equal to or less than the curvature radius in the product shape, thereby resulting in generation of a small compressive stress in the top plate part 1 and a small tensile stress in the flange parts 2 in the restrike forming in the second step 10B. Accordingly, in the top plate part 1, the small compressive stress remains, or the tensile stress generated in the first Step 10A and the compressive stress generated in the second step 10B cancel each other, so that the stress in the longitudinal direction is close to zero. Similarly, in the flange parts 2, the small tensile stress remains, or the compressive stress generated in the first step 10A and the tensile stress generated in the second step 10B cancel each other, so that the residual stress in the longitudinal direction is close to zero. Accordingly, the stress difference is reduced or becomes zero, thereby resulting in reduction in the amount of spring-back in the product shape, and the material strength sensitivity can be improved when the material strength varies.

When the amount of change in the curvature of the intermediate component with respect to the product shape is determined, in the first step 10A, spring-back calculation of the hat-shaped cross-section member curved at the curvature radius in the product shape is performed, and a ratio of the curvature radius R1' of the top plate part 1 after the spring-back to the curvature radius $R1_o$ of the top plate part 1 in the product shape is preferably set to be within the range of $0.70 \leq (R1'/R1_o) < 1.00$.

Similarly, a ratio of the curvature radius R2' of each of the flange parts 2 of the intermediate component with respect to the product shape to the curvature radius $R2_o$ of each of the flange parts 2 in the product is preferably set to be within the range of $0.70 \leq (R2'/R2_o) < 1.00$.

When $(R1'/R1_o)$ and $(R2'/R2_o)$ are less than 0.7, an excessive compressive stress is generated in the top plate part 1 and an excessive tensile stress is generated in the flange parts 2 at a bottom dead center of the die of the second step 10B, and thus, large spring-go might be generated in the press formed product. In contrast, when $(R1'/R1_o)$ and $(R2'/R2_o)$ are more than 1, the tensile stress remains in the top plate part 1 and the compressive stress remains in the flange parts 2 at a bottom dead center of the die of the second step 10B, and thus, the spring-back might not be sufficiently suppressed.

As described above, according to the method for manufacturing a press formed product of the present embodiment, even when a high tensile strength steel sheet is used for a metal sheet, spring-back in a side view, that is, camber-back, and the material strength sensitivity of the camber-back can be greatly reduced without complicating a die. Accordingly, a press formed product having a high-accuracy hat-shaped cross-section close to an intended product shape and a shape with a curve in a longitudinal direction can be obtained. As just described, the method for manufacturing a press formed product of the present embodiment has excellent shape fixability and material strength sensitivity.

As a result, according to the present embodiment, even when the material strength varies, a component having high dimensional accuracy can be obtained, thereby leading to improvement in yield. Furthermore, when a vehicle structural component is made using a component having a hat-shaped cross-sectional shape, assembly of the component can be easily performed.

EXAMPLES

In order to confirm a spring-back suppression effect by the method for manufacturing a press formed product according to aspects of the present invention, press forming analysis and spring-back analysis by a finite element method (FEM) were performed. The results are described below.

Figure 2A:
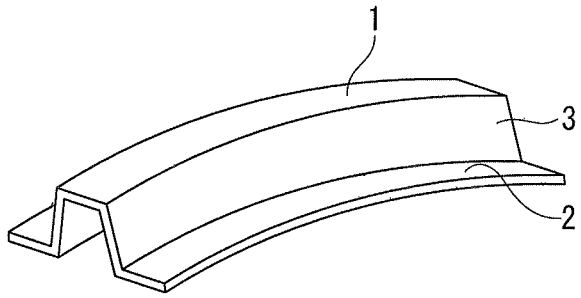
Figure 2B:
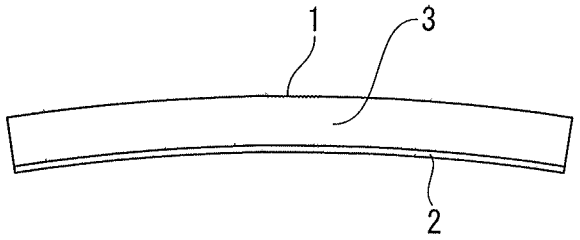
Figure 3A:
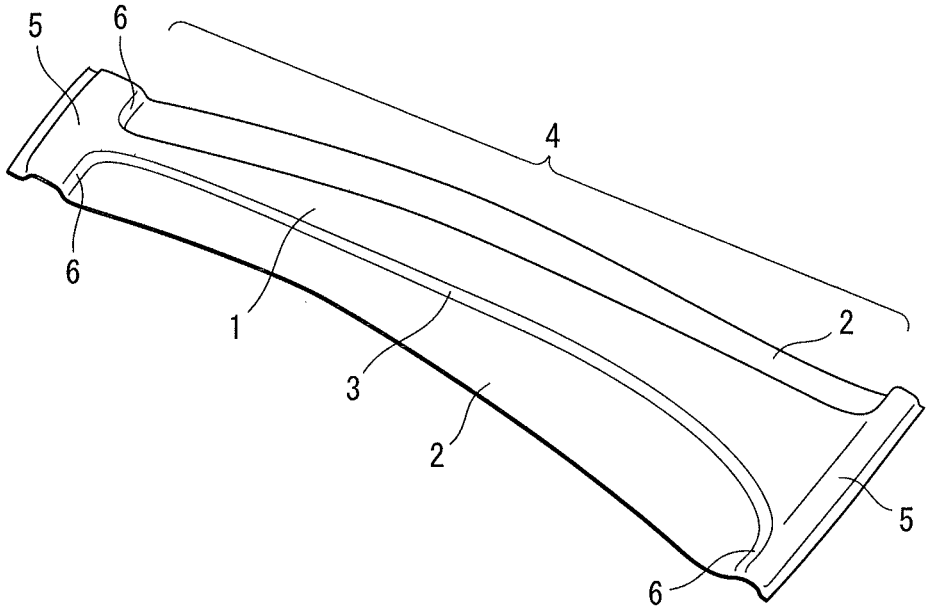
FIG. 3 is a view illustrating an example of an actual component shape curved along a longitudinal direction in aside view.
Figure 3B:
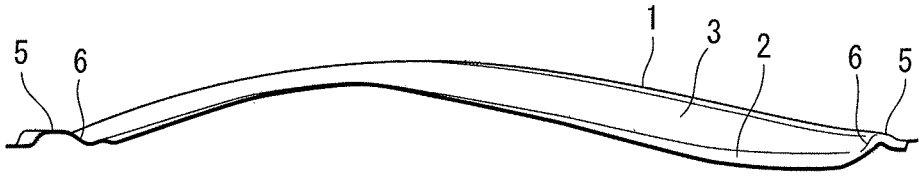

In the present example, the case where the hat-shaped cross-section component curved in the longitudinal direction illustrated in FIGS. 2A and 2B is press formed was targeted.

In the present example, the case where the hat-shaped cross-section member curved in the longitudinal direction illustrated in FIGS. 2A and 2B is press formed was targeted. A punch bottom product curvature radius in a side view was a constant curvature of R1600, and the die shape in the preceding step and the die shape in the subsequent step were made different.

Press conditions and evaluation results are collectively shown in Table 1.

A metal sheet used in press forming was a steel sheet having a sheet thickness of t=1.4 mm and a tensile strength (material strength) of from 590 MPa to 1180 MPa.

TABLE 1

| | | First Step | | | Second Step | | Curvature Radius Difference |
|---|---|---|---|---|---|---|---|
| No. | Material Strength | Longitudinal Curvature Radius of Die [mm] | Longitudinal Curvature Radius after SB [mm] | $R1'/R1_o$ | Longitudinal Curvature Radius of Die [mm] | Longitudinal Curvature Radius after SB [mm] | between 590 Material and 1180 Material [mm] |
| 1 | 590 | R1600 | 1724 | — | — | — | 206 |
| 2 | 980 | | 1826 | — | | — | |
| 3 | 1180 | | 1930 | — | | — | |
| 4 | 590 | R1100 | 1185 | 0.7 | R1600 | 1493 | −16 |
| 5 | 980 | | 1247 | 0.8 | | 1474 | |
| 6 | 1180 | | 1294 | 0.8 | | 1477 | |
| 7 | 590 | R1200 | 1290 | 0.8 | R1700 | 1605 | 2 |
| 8 | 980 | | 1363 | 0.9 | | 1590 | |
| 9 | 1180 | | 1420 | 0.9 | | 1607 | |

(No. 1 to No. 3)

No. 1 to No. 3 (conventional method) are results of forming by one step using a die having a product punch bottom curvature of R1600. In No. 1 to No. 3 (conventional method), press forming analysis and spring-back analysis were performed, and the amount of spring-back (curvature radius) of the top plate part 1 before and after the spring-back was determined.

In this case, the curvature radius after the spring-back of each material strength becomes larger than that of the product shape, and the curvature radius becomes larger with increasing the material strength. Furthermore, the curvature radius difference between the 590 MPa material that is the lower limit and the 1180 MPa material was 206 [mm].

(No. 4 to No. 6)

In No. 4 to No. 6, under conditions where forming is performed with a die of R1100 such that the curvature radius after the spring-back of the first step 10A becomes smaller than the product curvature of R1600 and restrike is performed at the product curvature of R1600 in the second step 10B, press forming analysis was performed.

In this case, the curvature radii after the spring-back of the first step 10A became smaller than the product curvature of R1600 at all the material strengths. When the shape was restruck at the product curvature of R1600 in the second step 10B, curvature radii smaller than 81600 were obtained at all the material strengths, and substantially the same curvature radii were obtained at all the material strengths. Furthermore, the curvature radius difference between the 590 MPa material that is the lower limit and the 1180 MPa material was −16 [mm]. The curvature radius difference was considerably reduced compared to the conventional method.

(No. 7 to No. 9)

In No. 7 to No. 9 based on aspects of the present invention, press forming analysis, in which forming is performed with a die of R1200 such that the curvature radius after the spring-back of the first step 10A becomes smaller than the product curvature of R1600 and forming is performed at R1700 larger than the product curvature of R1600 in the second step 10B, was performed.

In this case, the curvature radii after the spring-back of the first step 10A became smaller than the product curvature of 81600 at all the material strengths. When the shape was formed at 81700 in the second step 10B, curvatures same as the product curvature of 81600 were obtained at all the material strengths, and substantially the same curvature radii were obtained at all the material strengths.

Furthermore, the curvature radius difference between the 590 MPa material that is the lower limit and the 1180 MPa material was 2 [mm]. The curvature radius difference was considerably reduced compared to the conventional method. Furthermore, the curvature radius difference was reduced also compared to No. 4 to No. 6.

The entire contents of Japanese Patent Application No. 2017-150070 (filed on Aug. 2, 2017) to which the present application claims priority are a part of the present disclosure by reference.

Although the present invention has been described with reference to the limited number of embodiments, the scope of the present invention is not limited thereto, and modifications of the respective embodiments based on the above disclosure are obvious to those skilled in the art.

REFERENCE SIGNS LIST

1 top plate part
2 flange part
3 side wall part
4 main body part
5 projection part
6 vertical wall part
10A first step
10B second step

The invention claimed is:

1. A method for manufacturing a press formed product comprising:

when a metal sheet is press formed to manufacture a product having a product shape of a hat-shaped cross-section, in which a top plate part and a flange part are continuous in a width direction through a side wall part and the top plate part and the flange part curve convexly or concavely toward the top plate part along a longitudinal direction, a first step of manufacturing an intermediate component by press forming into a component shape having a hat-shaped cross-section, in which a curve of each of the top plate part and the flange part along the longitudinal direction has a second curvature radius smaller than a curvature radius in the product shape; and a second step of press forming the curve of the intermediate component along the longitudinal direction to have a larger curvature radius than the product shape.

2. The method for manufacturing a press formed product according to claim 1, wherein the second curvature radius of each of the top plate part and the flange part is set to be a value such that a curvature radius after spring-back generated in the intermediate component after the forming in the first step is equal to or less than the curvature radius in the product shape.

3. The method for manufacturing a press formed product according to claim 1, wherein, when a curvature radius of the top plate part along the longitudinal direction of the top plate part in the product shape is defined as $R1_o$, the value of the second curvature radius in the top plate part is set such that a curvature radius R1' of the top plate part along the longitudinal direction after the spring-back in the intermediate component becomes a value that satisfies the following equation (1):

$$0.70 \leq (R1'/R1_o) < 1.00 \quad (1).$$

4. The method for manufacturing a press formed product according to claim 1, wherein, when a curvature radius of the flange part along the longitudinal direction in the product shape is defined as $R2_o$, the value of the second curvature radius in the flange part is set such that a curvature radius R2' of the flange part along the longitudinal direction after the spring-back in the intermediate component becomes a value that satisfies the following equation (2):

$$0.70 \leq (R2'/R2_o) < 1.00 \quad (2).$$

5. The method for manufacturing a press formed product according to claim 1, wherein drawing or stamping is applied to the forming in the first step, and restrike processing is applied to the forming in the second step.

6. The method for manufacturing a press formed product according to claim 1, wherein the metal sheet is a steel sheet having a material strength of 590 MPa or more.

7. The method for manufacturing a press formed product according to claim 3, wherein, when a curvature radius of the flange part along the longitudinal direction in the product shape is defined as R2O, the value of the second curvature radius in the flange part is set such that a curvature radius R2' of the flange part along the longitudinal direction after the spring-back in the intermediate component becomes a value that satisfies the following equation (2):

$$0.70 \leq (R2'/R2O) < 1.00 \quad (2).$$

8. The method for manufacturing a press formed product according to claim 2, wherein, drawing or stamping is applied to the forming in the first step, and restrike processing is applied to the forming in the second step.

9. The method for manufacturing a press formed product according to claim 3, wherein, drawing or stamping is applied to the forming in the first step, and restrike processing is applied to the forming in the second step.

10. The method for manufacturing a press formed product according to claim 4, wherein, drawing or stamping is applied to the forming in the first step, and restrike processing is applied to the forming in the second step.

11. The method for manufacturing a press formed product according to claim 7, wherein, drawing or stamping is applied to the forming in the first step, and restrike processing is applied to the forming in the second step.

12. The method for manufacturing a press formed product according to claim 2, wherein, the metal sheet is a steel sheet having a material strength of 590 MPa or more.

13. The method for manufacturing a press formed product according to claim 3, wherein, the metal sheet is a steel sheet having a material strength of 590 MPa or more.

14. The method for manufacturing a press formed product according to claim 4, wherein, the metal sheet is a steel sheet having a material strength of 590 MPa or more.

15. The method for manufacturing a press formed product according to claim 5, wherein, the metal sheet is a steel sheet having a material strength of 590 MPa or more.

16. The method for manufacturing a press formed product according to claim 7, wherein, the metal sheet is a steel sheet having a material strength of 590 MPa or more.

17. The method for manufacturing a press formed product according to claim 8, wherein, the metal sheet is a steel sheet having a material strength of 590 MPa or more.

18. The method for manufacturing a press formed product according to claim 9, wherein, the metal sheet is a steel sheet having a material strength of 590 MPa or more.

19. The method for manufacturing a press formed product according to claim 10, wherein, the metal sheet is a steel sheet having a material strength of 590 MPa or more.

20. The method for manufacturing a press formed product according to claim 11, wherein, the metal sheet is a steel sheet having a material strength of 590 MPa or more.

* * * * *